US012180833B1

(12) United States Patent
Zhang

(10) Patent No.: US 12,180,833 B1
(45) Date of Patent: Dec. 31, 2024

(54) ROTARY STEERABLE SYSTEM STEERING PAD ACTUATOR FOR WELLBORE DRILLING

(71) Applicant: Halliburton Energy Services, Inc., Houston, TX (US)

(72) Inventor: Lizheng Zhang, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/342,593

(22) Filed: Jun. 27, 2023

(51) Int. Cl.
*E21B 7/06* (2006.01)

(52) U.S. Cl.
CPC ..... *E21B 7/06* (2013.01)

(58) Field of Classification Search
CPC ..... E21B 7/06; E21B 7/04
See application file for complete search history.

(56) References Cited

U.S. PATENT DOCUMENTS

| | | | | |
|---|---|---|---|---|
| 8,157,024 | B2 | 4/2012 | Neves et al. | |
| 8,474,552 | B2 | 7/2013 | Neves et al. | |
| 10,683,702 | B2 | 6/2020 | Conger et al. | |
| 11,187,042 | B2 | 11/2021 | Doud et al. | |
| 11,396,774 | B2 | 7/2022 | Chambers et al. | |
| 2010/0139980 | A1* | 6/2010 | Neves | E21B 7/06 175/76 |
| 2012/0118643 | A1 | 5/2012 | Neves et al. | |
| 2016/0002978 | A1* | 1/2016 | Rushton | E21B 7/06 175/76 |
| 2019/0128071 | A1 | 5/2019 | Conger et al. | |
| 2020/0318436 | A1 | 10/2020 | Doud et al. | |
| 2020/0325731 | A1* | 10/2020 | Chambers | E21B 7/06 |
| 2020/0332599 | A1* | 10/2020 | Doud | E21B 7/06 |
| 2020/0392790 | A1 | 12/2020 | Perry et al. | |
| 2021/0087885 | A1 | 3/2021 | Chambers et al. | |
| 2022/0268102 | A1 | 8/2022 | Zhang et al. | |

OTHER PUBLICATIONS

"PCT Application No. PCT/US2023/069312, International Search Report and Written Opinion", Mar. 15, 2024, 12 pages.

* cited by examiner

*Primary Examiner* — Brad Harcourt
(74) *Attorney, Agent, or Firm* — DeLizio, Peacock, Lewin & Guerra, LLP

(57) ABSTRACT

A rotary steerable system (RSS), the RSS including steering collar pockets, actuation cylinders positioned in the steering collar pockets, barrel-shaped pistons positioned in the actuation cylinders and pad actuators attached to the pistons. Each barrel-shaped piston includes a piston hanger; each pad actuator includes a pad housing mounted on the steering collar and a steering pad. Each steering pad is pivotably coupled to one of the pad housings via a first hinge pin and is directly connected via a second hinge pin to the piston hanger of at least one of the pistons. Each barrel-shaped piston is movable within its respective actuation cylinder such that, when extended out of the actuation cylinder, its respective steering pad pivots laterally from the steering collar on the first hinge pin to contact a side of a wellbore, urging the steering collar in a direction opposite the lateral direction.

20 Claims, 4 Drawing Sheets

ROTARY STEERABLE SYSTEM STEERING PAD ACTUATOR FOR WELLBORE DRILLING

BACKGROUND

As part of hydrocarbon recovery operations, a wellbore can be formed in a subterranean formation for extracting produced hydrocarbon material or other suitable material. The wellbore may experience or otherwise encounter one or more wellbore operations such as drilling the wellbore. Drilling, or otherwise forming, the wellbore can involve using a drilling system that can include a drill bit and other suitable tools or components for forming the wellbore. During drilling, the drilling system may change the course (e.g., speed, direction, etc.) of the drill bit to form a wellbore that may not be purely vertical.

BRIEF DESCRIPTION OF THE DRAWINGS

Embodiments of the disclosure may be better understood by referencing the accompanying drawings.

Like reference numbers and designations in the various drawings indicate like elements.

DETAILED DESCRIPTION

Figure 1:
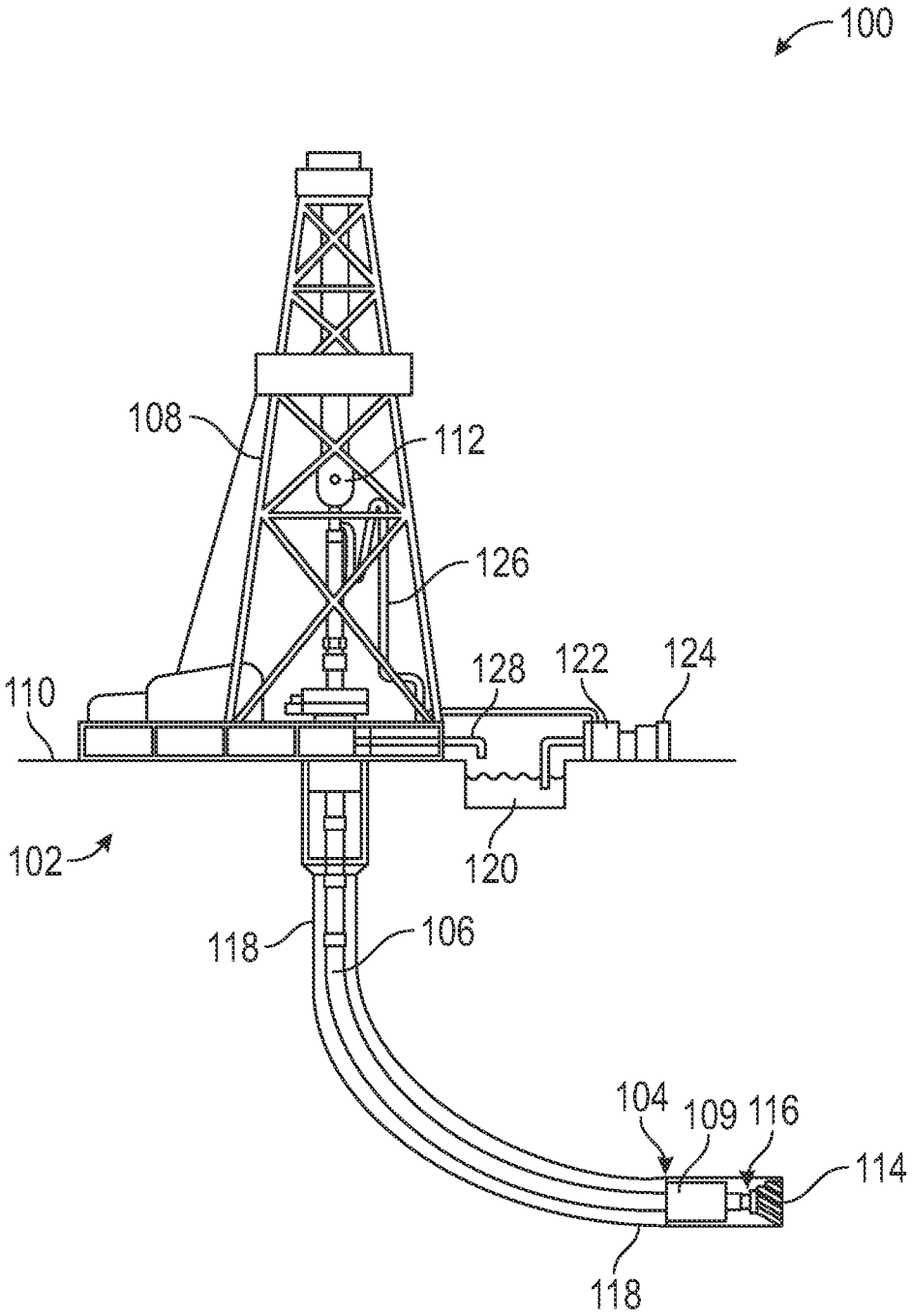
FIG. 1 is an elevation view in partial cross section of an example well system that supports directional drilling, according to aspects of the present disclosure.

The description that follows includes example systems, methods, techniques, and program flows that embody embodiments of the disclosure. Unless otherwise specified, use of the terms "connect." "engage." "couple." "attach." or any other like term describing an interaction between elements is not meant to limit the interaction to a direct interaction between the elements and may also include an indirect interaction between the elements described. Unless otherwise specified, use of the terms "up." "upper," "upward," "uphole." "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

Certain aspects and features of the present disclosure relate to a bottom hole assembly (BHA) having a rotary steerable system (RSS) connected to a drill bit through a tool string, the drill bit for drilling into a subterranean formation to form a wellbore for extracting produced hydrocarbons. The RSS includes a steering collar and one or more pad actuators. In some examples, the steering collar may be a frame of the tool string, stiffening the tool string. In some examples, the pad actuators may be mounted on the steering collar to exert force on the side of a wellbore to change the direction of drilling while forming the wellbore.

As further described below, instead of a sliding slot connection, example implementations may include a pad actuator that includes a piston that is connected to pad through a hinge, such that the piston may pivot around the hinge axis when the pad opens and closes. Example implementations may include a barrel shaped piston connected to a flapper pad through a hinge (cylinder may be a straight bore). Accordingly, example implementations are different from conventional approaches because the piston may be directly connected to the pad through the hinge (there is no linkage arm pivotably connected to both the piston and the pad). Thus, example implementations may include a piston/cylinder/pad arrangement that reduces slot wear and likelihood of the piston jamming in a rotary steerable system (thereby improving the steering performance as a result).

In one example approach, an actuation cylinder may actuate or otherwise open in response to receiving pressurized drilling mud. By actuating, the actuation cylinder may use pistons to actuate or otherwise engage a steering pad that, when engaged, exerts force on the wellbore to change the direction of drilling of the drilling string. Rotary steerable systems may also include seals positioned between the steering collar and the actuation cylinder. In some example approaches, face seals and/or radial seals may be positioned between the steering collar and the actuation cylinder.

In one example approach, at least one orifice is added to the piston, to the actuation cylinder, to the steering collar, or a combination thereof to indicate an actuation state of each steering pad. A jet of mud ejected from the orifice can indicate that the associated pad is energized. A port to accommodate the orifice on the steering collar may in addition or alternatively be used to evaluate performance, such as pad pressure and pad force, of a radial seal without disassembling the rotary steerable system.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

Example Well System

FIG. 1 is an elevation view in partial cross section of an example well system that supports directional drilling, according to aspects of the present disclosure. In the example shown in FIG. 1, the well system 100 directs a drill bit 114 in drilling a wellbore 118 through a subterranean formation 102, such as a subsea well or a land well. Example embodiments are not limited to only drilling an oil well. Some implementations may also encompass natural gas wellbores, other hydrocarbon wellbores, or wellbores in general. Further, some implementations may be used for the exploration and formation of geothermal wellbores intended to provide a source of heat energy instead of hydrocarbons.

In the example shown in FIG. 1, well system 100 includes a drill string 106 attached to a derrick 108 and a bottom hole assembly (BHA) 104; the BHA 104 may be positioned or otherwise arranged at the bottom of the drill string 106. The derrick 108 may be located at the surface 110 and may, in some example approaches, include a kelly 112 connected to drill string 106; the kelly 112 may be used, for instance, to lower and raise the drill string 106.

The BHA 104 may include a drill bit 114, a rotary steerable system 109, other suitable components, or a combination thereof. The drill bit 114 may, in some examples, be operatively coupled to a tool string 116, with the tool string 116 attached to the drill string 106 such that the drill bit 114 may be moved axially within drilled wellbore 118. During operation, the drill bit 114 can penetrate the subterranean formation 102 to extend the wellbore 118.

The BHA 104 may control the drill bit 114 as the drill bit 114 advances into the subterranean formation 102. For example, the BHA 104 may use the rotary steerable system 109 to change a direction of drilling by applying a steering pressure or other suitable force to a wall of the wellbore 118.

In the example shown in FIG. 1, fluid such as a drilling mud may be pumped downhole from a mud tank 120 using a mud pump 122 that may be powered by an adjacent power source, such as a prime mover (or motor) 124. The mud may be pumped from the mud tank 120, through a stand pipe 126, which feeds the mud through the drill string 106 to the rotary steerable system 109, or other suitable components of the well system 100, and on to the drill bit 114. The mud may, in some examples, exit one or more nozzles (not shown) arranged in the drill bit 114 and may thereby cool the drill bit 114. Additionally or alternatively, the mud may be directed (e.g., as pressurized mud) into the rotary steerable system 109 for adjusting a direction of the drill bit 114, as discussed in further detail below.

After exiting the drill bit 114 or other suitable component, the mud may circulate back to the surface 110 via an annulus defined between the wellbore 118 and the drill string 106. The returning mud transports cuttings from the wellbore 118 into the mud tank 120 and aids in maintaining the integrity of the wellbore 118. For example, cuttings and mud mixture passed from the annulus through the flow line 128 may be processed such that a cleaned mud is returned down hole through the stand pipe 126.

In some examples, the rotary steerable system 109 may include a steering collar, one or more actuation cylinders, and a radial seal for each cylinder. The steering collar may be designed to provide a rigid frame for the rotary steerable system 109. In one example approach, each actuation cylinder is mounted in a pocket of the steering collar, with a radial seal installed between each actuation cylinder and the steering collar; the radial seal forms a pressure seal or other suitable type of seal for each actuation cylinder in the rotary steerable system 109. In one such example approach, the radial seal allows the rotary steerable system 109 to receive pressure (e.g., via pressurized mud) used to apply the steering force without incurring damage, obstruction, excessive wear, or other related undesirable effects from the pressure. In one example approach, a piston positioned in each actuation cylinder may be used to apply the steering pressure or other suitable forces to the wall of the wellbore.

The tool string 116 may include one or more logging while drilling (LWD) or measurement-while-drilling (MWD) tools that collect data and measurements relating to various borehole and formation properties as well as the position of the drill bit 114 and various other drilling conditions as the drill bit 114 extends the wellbore 118 through the formations 102. The LWD/MWD tools may include a device for measuring formation resistivity, a gamma ray device for measuring formation gamma ray intensity, devices for measuring the inclination and azimuth of the tool string 116, pressure sensors for measuring drilling fluid pressure, temperature sensors for measuring borehole temperature, etc.

In the example shown in FIG. 1, RSS 109 is configured to change the direction of the tool string 116 and/or the drill bit 114, such as based on information indicative of tool orientation and a desired drilling direction received from a drilling application. In one or more embodiments, the RSS 109 is coupled to the drill bit 114 and may drive rotation of the drill bit 114. Specifically, the RSS 109 may rotate in tandem with the drill bit 114 or may rotate at a fraction of the rate of drill bit 114. In some implementations, the rotary steerable tool 109 may be a point-the-bit system or a push-the-bit system.

Figure 2:
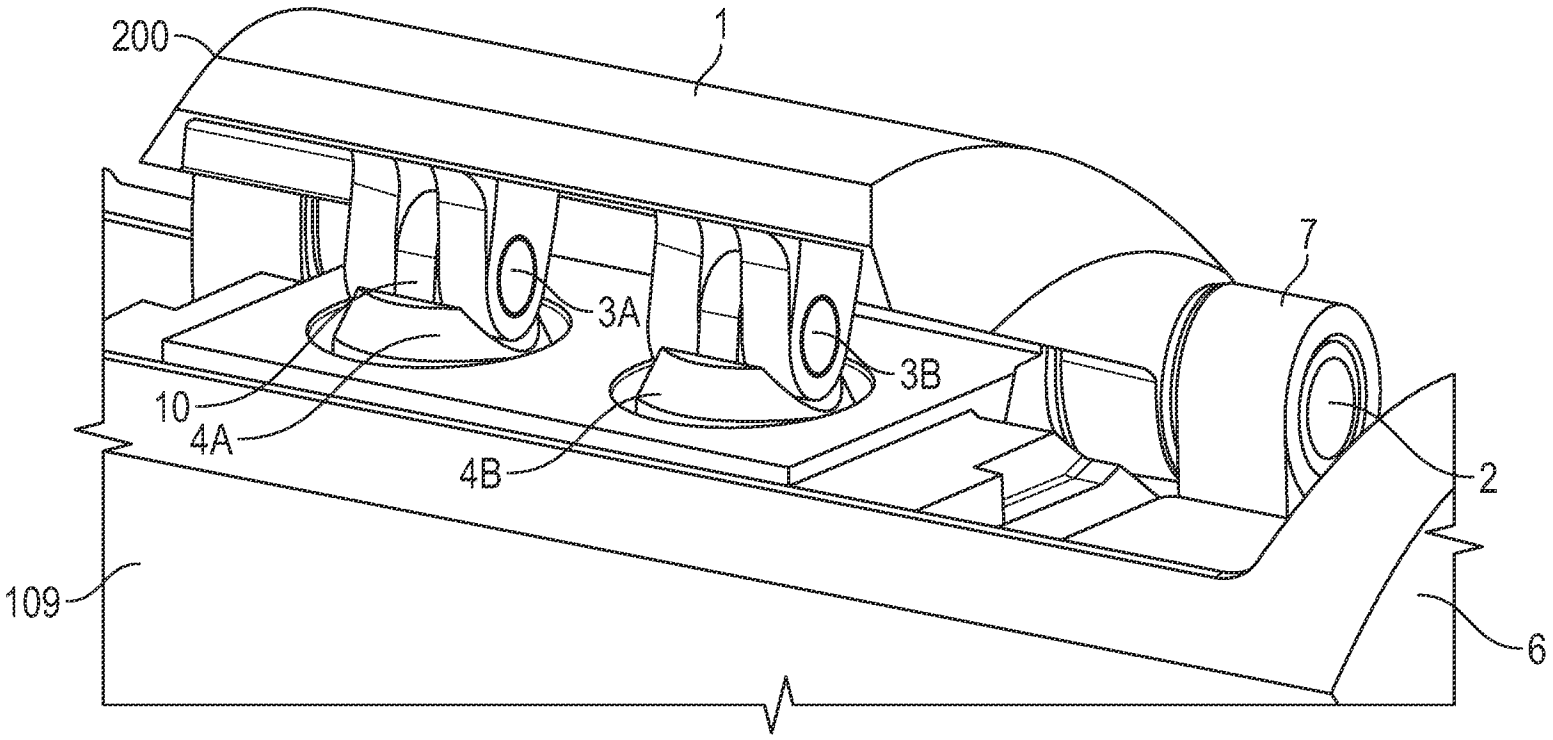
FIG. 2 is a perspective view of a pad actuator according to aspects of the present disclosure.

FIG. 2 is a perspective view of a pad actuator 200 according to aspects of the present disclosure. In the example shown in FIG. 2, pad actuator 200 is attached to a steering collar 6 of an RSS 109. Pad actuator 200 includes a steering pad 1 connected through a hinge pin 2 to a pad housing 7 mounted on steering collar 6. In the example shown, steering pad 1 is also connected through hinge pins 3A and 3B (collectively, hinge pins 3) to pistons 4A and 4B (collectively, pistons 4), respectively. In the example shown in FIG. 2, each piston 3 is positioned in an actuation cylinder mounted in a pocket of the steering collar 6, as will be discussed in further detail below.

In some example approaches, steering pad 1 may be connected through a single hinge pin 3 to a single piston 4 positioned in an actuation cylinder; again, each actuation cylinder is mounted in a pocket of the steering collar 6. The pad actuator 200 may include other suitable amounts (e.g., three or more) of pistons 4 connected through hinge pins 3 to pads 1. Pistons 4 may also include an orifice (not shown) for directing drilling mud through piston 4.

In one example approach, RSS 109 includes a steering collar 6 having one or more pockets. RSS 109 further includes one or more pistons 4, one or more actuation cylinders (not shown), and one or more pad actuators 200. Each piston 4 includes a piston hanger 10. Each actuation cylinder is mounted in a pocket of the steering collar 6, with a barrel-shaped piston 4 positioned in each actuation cylinder, as shown in FIG. 2. In some example approaches, the actuation cylinder is positioned abutting the steering pad 1 or in other suitable positions with respect to pad actuator 200.

In the example shown in FIG. 2, each pad actuator 200 includes a steering pad 1 pivotably connected to a pad housing 7 via a hinge pin 2. Steering pad 1 is also coupled via a second hinge pin (hinge pin 3) to the piston hanger 10 of one or more pistons 4. In operation, each barrel-shaped piston 4 is movable within its respective actuation cylinder such that, when extended out of the actuation cylinder, its respective steering pad 1 pivots laterally from the steering collar 6 on hinge pin 2 to contact a side of the wellbore, urging the steering collar 6 in a direction opposite the lateral direction.

Figure 3:
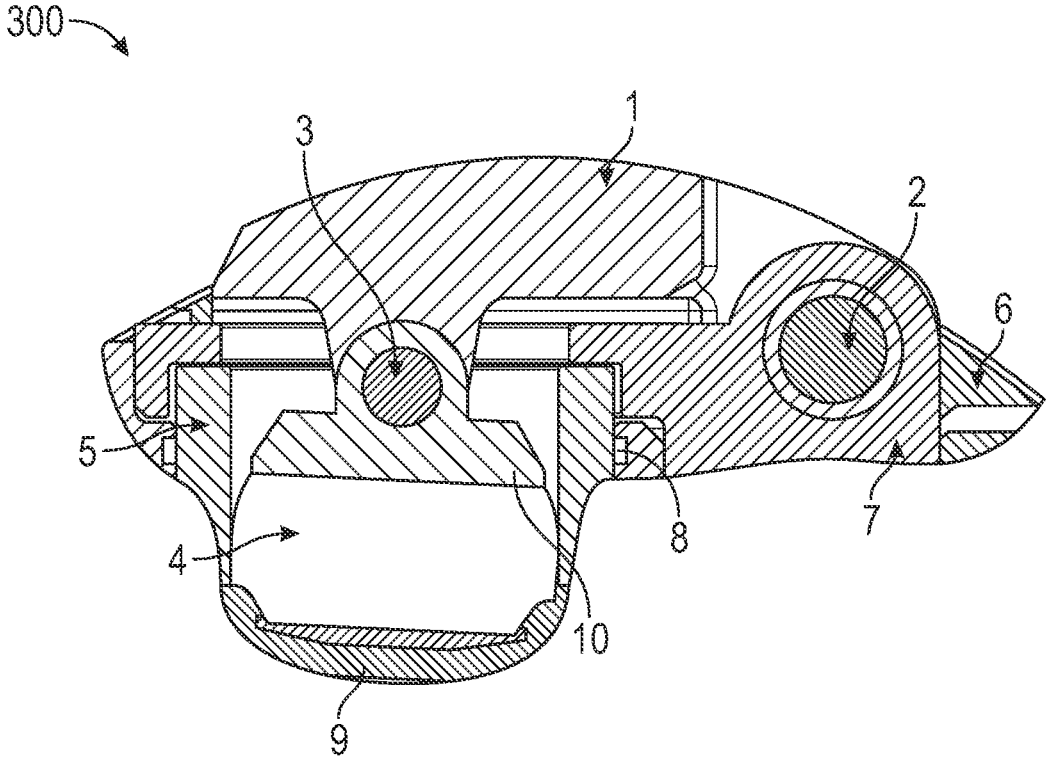
FIG. 3 provides two sectional side-views of a pad actuator coupled to a piston, the piston shown in two positions within an actuation cylinder, according to aspects of the present disclosure.
Figure 3:
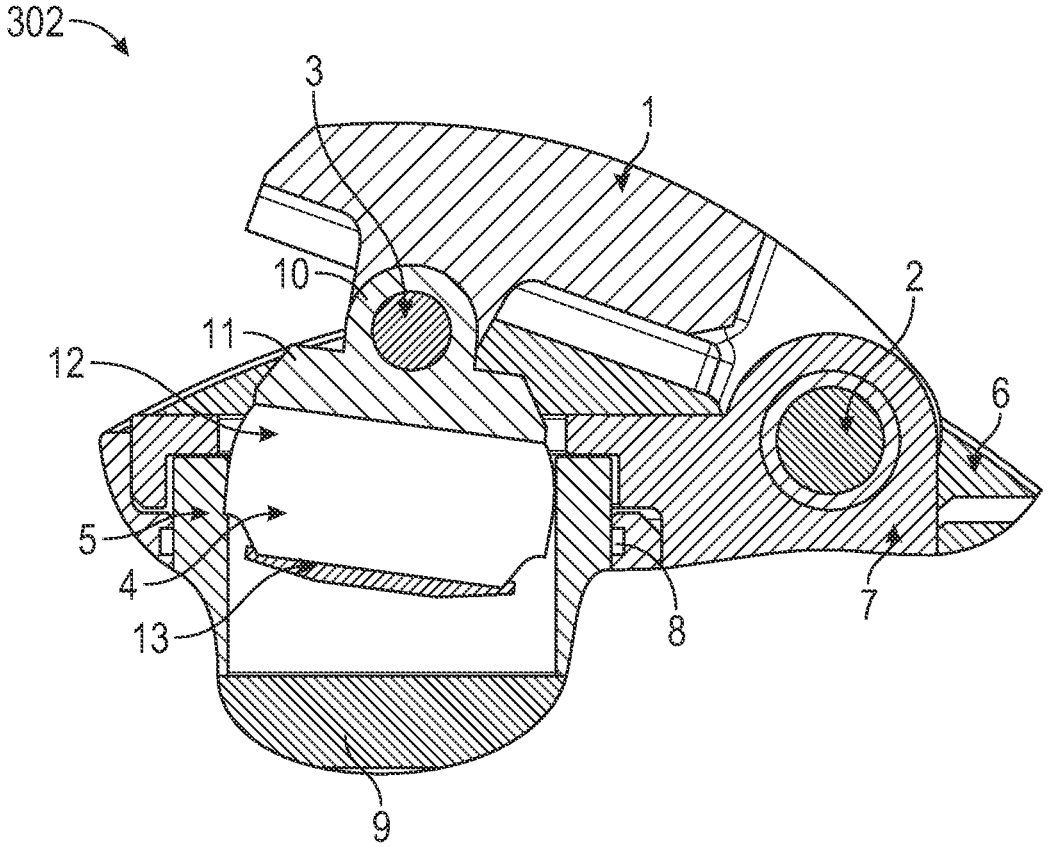

FIG. 3 provides two sectional side-views (300 and 302) of a pad actuator 200 coupled to a piston 4, according to aspects of the present disclosure. The pad actuator 200 may be mounted to steering collar 6 (as shown in FIG. 2). In side-view 300, piston 4 is seated in actuation cylinder 5 while, in side-view 302, piston 4 is extended upward in actuation cylinder 5, pivoting on hinge pin 3 and pushing steering pad 1 so that steering pad 1 pivots radially outward from hinge pin 2. A hydraulic chamber 9 is defined in the steering collar 6 adjacent to each piston 4. The hydraulic chamber 9 may selectively be pressurized to extend pistons 4 to an extended position as shown in side-view 302. In the extended position, pistons 4 push on steering pad 1 to pivot the steering pad 1 radially outward on an axis through hinge pin 2. Relieving the hydraulic pressure from the hydraulic chamber 9 permits the piston 4 to return to a retracted position as shown in side-view 300.

In the examples shown in FIG. 3, RSS 109 includes an actuation cylinder 5 mounted in a pocket of steering collar 6. The steering collar 6 may be a rigid frame of the rotary steerable system 109 or other suitable component of drill string 106. The actuation cylinder 5 may be positioned abutting steering pad 1 or in other suitable positions with respect to the pad actuator 200.

In the examples shown in FIG. 3, each piston 4 includes a piston hanger 10. Each piston hanger 10 includes a piston hanger top 11 and a piston hanger bottom 13. In some examples, the piston hanger 10 extends through the center of the piston 4 and, in some such examples, a barrel of piston 4 rotates freely around the piston hanger 10. Such an approach can be advantageous in spreading wear around the outside of barrel-shaped piston 4.

In the examples shown in FIG. 3, the pad actuator 200 includes a steering pad 1 pivotably connected to a pad housing 7 via a hinge pin 2. Steering pad 1 is also coupled via a second hinge pin (i.e., hinge pin 3) to the piston hanger top 11. In operation, each barrel-shaped piston 4 is movable within its respective actuation cylinder 5 such that, when extended out of the actuation cylinder 5, its respective steering pad 1 pivots laterally from the steering collar 6 on hinge pin 2 to contact a side of the wellbore, urging the steering collar 6 in a direction opposite the lateral direction. In one such example approach, a portion of piston 4 is coated with a wear-resistant material 12 such as tungsten or diamond.

In some example approaches, a seal is engineered between the piston 4 and the interior wall of actuation cylinder 5. In some such example approaches, the seal is a metal-to-metal seal used to limit fluid leaks past pistons 4 through the bore hole of actuation cylinder 5. The seal between the piston 4 and the interior wall of actuation cylinder 5 may, for instance, contain or retain pressurized drilling mud received from upstream by the hydraulic chamber 9 shown in FIG. 3.

As noted above, in some examples, the pressurized mud in hydraulic chamber 9 acts on the piston 4 such that piston 4 exerts a force against pad 1. The pad 1 may pivot on the pad housing 7 (e.g., around hinge pin 2) to exert a force against the wellbore being drilled. The force against the wellbore 118 may be a steering force that is used to change the direction of drilling performed by the pad actuator 300. In some examples, the RSS 109 may be positioned adjacent to or otherwise proximate to the drill bit 114.

In some example approaches, the RSS 109 may additionally include a seal that is positioned between the steering collar 6 and the actuation cylinder 5. The seal may provide a seal for the actuation cylinder 5 for allowing a piston 4 or the actuation cylinder 5 to receive pressure (e.g., via pressurized mud or gas) to exert pressure on steering pad 1 during a drilling operation. In the examples shown in FIG. 3, seal 8 is a radial seal that extends around the outside of actuation cylinder 5 in a gap between the actuation cylinder 5 and the steering collar 6. The pressurized mud in hydraulic chamber 9 may therefore act on the piston 4, and the piston 4 may then exert a force against pad 1. The pad 1 may pivot on the pad housing 7 (e.g., via hinge pin 2) to exert a force against the wellbore being drilled. The force against the wellbore 118 may be a steering force that can change the direction of drilling performed by the pad actuator 300. In other example approaches, the seal for actuation cylinder 5 is a face seal.

Example Operations

Figure 4:
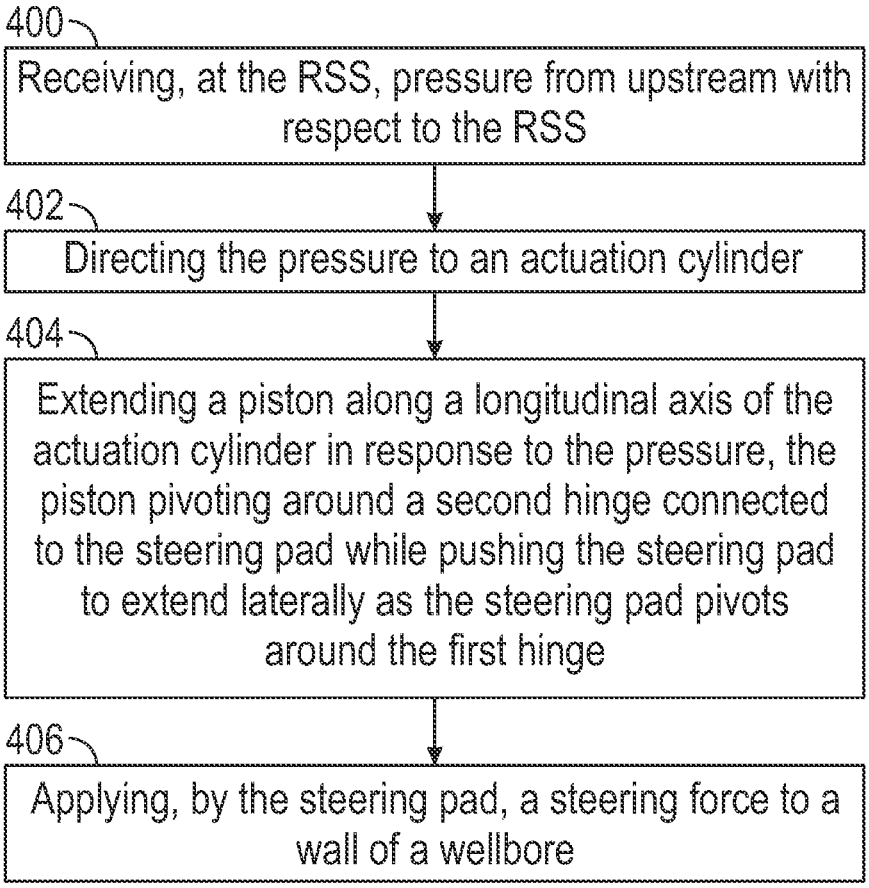
FIG. 4 is a flowchart illustrating a method of directional drilling, according to aspects of the present disclosure.

FIG. 4 is a flowchart illustrating a method of directional drilling, according to aspects of the present disclosure. In the flowchart of FIG. 4, a method includes receiving (400), at an RSS, pressure from upstream to the RSS, directing (402) the pressure to an actuation cylinder 5 mounted on a steering collar 6 of the RSS 109, extending (404) a piston 4 along a longitudinal axis of the actuation cylinder 5 in response to the pressure, the piston 4 pivoting around a second hinge pin 3 connected to the steering pad 1 while pushing the steering pad 1 to extend laterally as the steering pad 1 pivots around the first hinge pin 2, and applying (406), by the steering pad 1, a steering force to a wall of a wellbore 118. In one example approach, the piston 4 maintains an approximately similar gap with the cylinder 5 while pivoting around the second hinge pin 3.

In one such approach, the pressure received is a pressurized fluid such as a drilling mud. In one example, piston 4 includes an orifice and the pressurized mud received at the hydraulic chamber 9 is ejected from the orifice.

The RSS design described herein is advantageous because the piston is rigidly coupled to the steering pad via hinge pin 3, reducing wear on the steering pad and the piston due to vibration. In addition, the hinge pin approach described for coupling the piston to the steering pad, and the barrel-shaped design of the piston allow the use of a straight bore for actuation cylinder 5. In some examples, piston 4 rotates freely around a piston hanger 10.

Various modifications to the implementations described in this disclosure may be readily apparent to persons having ordinary skill in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Additionally, various features that are described in this specification in the context of separate implementations also can be implemented in combination in a single implementation. Conversely, various features that are described in the context of a single implementation also can be implemented in multiple implementations separately or in any suitable subcombination. As such, although features may be described above as acting in particular combinations, and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one or more example processes in the form of a flowchart or flow diagram. However, other operations that are not depicted can be incorporated in the example processes that are schematically illustrated. For example, one or more additional operations can be performed before, after, simultaneously, or between any of the illustrated operations. In some circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

Example Embodiments

Embodiment #1: A rotary steerable system (RSS), the RSS comprising: a steering collar, the steering collar including one or more pockets; one or more actuation cylinders, each actuation cylinder positionable within one of the pockets of the steering collar; one or more barrel-shaped pistons, each barrel-shaped piston positionable within one of the actuation cylinders, each piston including a piston hanger; and one or more pad actuators, each pad actuator including: a pad housing mounted on the steering collar and a steering pad, wherein each steering pad is pivotably coupled to one of the pad housings via a first hinge pin, wherein each steering pad is coupled via a second hinge pin to the piston hanger of at least one of the pistons, and wherein each barrel-shaped piston is movable within its respective actuation cylinder such that, when extended out of the actuation cylinder, its respective steering pad pivots laterally from the steering collar on the first hinge pin to contact a side of a wellbore, urging the steering collar in a direction opposite the lateral direction.

Embodiment #2: The RSS of Embodiment #1, wherein each piston moves within its respective actuation cylinder in response to an increase in hydraulic pressure, the movement causing the respective piston to pivot and laterally extend the steering pad to which the piston is coupled.

Embodiment #3. The RSS of any one of Embodiments #1 and 2, wherein a portion of each piston is coated with a wear resistant material.

Embodiment #4. The RSS of any one of Embodiments #1 and 2, wherein each piston has a gap defined between the piston and its respective actuation cylinder.

Embodiment #5. The RSS of any one of Embodiments #1 and 2, wherein each piston has a gap defined between the piston and its respective actuation cylinder, each piston maintaining an approximately similar gap with the actuation cylinder as the piston pivots on the second hinge pin.

Embodiment #6. The RSS of of any one of Embodiments #1 and 2, wherein each piston has a gap defined between the piston and its respective actuation cylinder, each piston maintaining an approximately similar gap with the actuation cylinder while traversing the actuation cylinder.

Embodiment #7. The RSS of of any one of Embodiments #1 and 2, wherein the RSS further comprises a radial seal positioned between each actuation cylinder and the steering collar.

Embodiment #8. The RSS of of any one of Embodiments #1 and 2, wherein the steering collar includes a plurality of hydraulic chambers, each hydraulic chamber positioned adjacent to one of the pistons at one end of the actuation cylinder, wherein pressurized fluid received by the RSS is directed to one or more of the hydraulic chambers and applied to the piston adjacent to the respective hydraulic chamber.

Embodiment #9. The RSS of of any one of Embodiments #1 and 2, wherein the barrel-shaped piston rotates around the piston hanger.

Embodiment #10. A method of steering a drill string, the drill string including a remote steerable system (RSS), the RSS including a pad actuator and a steering collar, the pad actuator having a steering pad and a pad housing, the pad housing mounted on the steering collar, the steering pad pivotably coupled to the pad housing via a first hinge pin, the method comprising: receiving, at the RSS, pressure from upstream with respect to the RSS; directing the pressure to an actuation cylinder mounted on the steering collar; extending a piston along a longitudinal axis of the actuation cylinder in response to the pressure, the piston pivoting around a second hinge pin connected to the steering pad while pushing the steering pad to extend laterally as the steering pad pivots around the first hinge pin, the piston maintaining an approximately similar gap with the cylinder while pivoting around the second hinge pin; and applying, by the steering pad, a steering force to a wall of a wellbore.

Embodiment #11. The method of Embodiment #10, wherein receiving pressure includes receiving a pressurized fluid.

Embodiment #12. The method of any one of Embodiments #10 and 11, wherein receiving pressure includes receiving, at one of the pistons, a pressurized drilling mud and ejecting the pressurized mud from an orifice of the piston.

Embodiment #13. A drill string for forming a wellbore, the drill string comprising: a drill bit; and a rotary steerable system (RSS) positioned upstream from the drill bit on the drill string, the RSS including: a steering collar, the steering collar including a plurality of pockets; a plurality of actuation cylinders, each actuation cylinder mounted within one of the pockets of the steering collar; a plurality of barrel-shaped pistons, each barrel-shaped piston positionable within one of the actuation cylinders, each piston including a piston hanger; and two or more pad actuators, each pad actuator including: a pad housing mounted on the steering collar; and a steering pad, wherein each steering pad is pivotably coupled to one of the pad housings via a first hinge pin, wherein each steering pad is coupled via a second hinge pin to the piston hanger of at least one of the pistons, and wherein each barrel-shaped piston is movable within its respective actuation cylinder such that, when extended out of the actuation cylinder, its respective steering pad pivots laterally from the steering collar on the first hinge pin to contact a side of the wellbore, urging the steering collar in a direction opposite the lateral direction.

Embodiment #14. The drill string of Embodiment #13, wherein each piston moves within its respective actuation cylinder in response to an increase in hydraulic pressure, the movement causing the respective piston to pivot and laterally extend the steering pad to which the piston is coupled.

Embodiment #15. The drill string of any one of Embodiments #13 and 14, wherein each piston has a gap defined between the piston and its actuation cylinder.

Embodiment #16. The drill string of any one of Embodiments #13 and 14, wherein each piston has a gap defined between the piston and its respective actuation cylinder, each piston maintaining an approximately similar gap with the actuation cylinder as the piston pivots on the second hinge pin.

Embodiment #17. The drill string of any one of Embodiments #13 and 14, wherein each piston has a gap defined between the piston and its respective actuation cylinder, each piston maintaining an approximately similar gap with the actuation cylinder while traversing the actuation cylinder.

Embodiment #18. The drill string of any one of Embodiments #13 and 14, wherein the RSS further includes a radial seal positioned between each actuation cylinder and the steering collar.

Embodiment #19. The drill string of any one of Embodiments #13 and 14, wherein the steering collar includes a plurality of hydraulic chambers, each hydraulic chamber positioned adjacent to one of the pistons at one end of the piston's respective actuation cylinder, wherein pressurized fluid received by the RSS is directed to one or more of the hydraulic chambers and applied to the piston adjacent to the respective hydraulic chamber.

Embodiment #20. The drill string of any one of Embodiments #13 and 14, wherein the barrel-shaped piston rotates around the piston hanger.

What is claimed is:

1. A rotary steerable system (RSS), the RSS comprising:

a steering collar, the steering collar including one or more pockets;

one or more actuation cylinders, each actuation cylinder positionable within one of the pockets of the steering collar;

one or more barrel-shaped pistons, each barrel-shaped piston positionable within one of the actuation cylinders, each piston including a piston hanger; and one or more pad actuators, each pad actuator including:

a pad housing mounted on the steering collar; and a steering pad, wherein each steering pad is pivotably coupled to one of the pad housings via a first hinge pin and wherein each steering pad is directly connected via a second hinge pin to the piston hanger of at least one of the pistons, wherein each barrel-shaped piston is movable within its respective actuation cylinder such that, when extended out of the actuation cylinder, its respective steering pad pivots laterally from the steering collar on the first hinge pin to contact a side of a wellbore, urging the steering collar in a direction opposite the lateral direction.

2. The RSS of claim 1, wherein each piston moves within its respective actuation cylinder in response to an increase in hydraulic pressure, the movement causing the respective piston to pivot and laterally extend the steering pad to which the piston is coupled.

3. The RSS of claim 1, wherein a portion of each piston is coated with a wear resistant material.

4. The RSS of claim 1, wherein each piston has a gap defined between the piston and its respective actuation cylinder.

5. The RSS of claim 1, wherein each piston has a gap defined between the piston and its respective actuation cylinder, each piston maintaining an approximately similar gap with the actuation cylinder as the piston pivots on the second hinge pin.

6. The RSS of claim 1, wherein each piston has a gap defined between the piston and its respective actuation cylinder, each piston maintaining an approximately similar gap with the actuation cylinder while traversing the actuation cylinder.

7. The RSS of claim 1, wherein the RSS further comprises a radial seal positioned between each actuation cylinder and the steering collar.

8. The RSS of claim 1, wherein the steering collar includes a plurality of hydraulic chambers, each hydraulic chamber positioned adjacent to one of the pistons at one end of the actuation cylinder, wherein pressurized fluid received by the RSS is directed to one or more of the hydraulic chambers and applied to the piston adjacent to the respective hydraulic chamber.

9. The RSS of claim 1, wherein the barrel-shaped piston rotates around the piston hanger.

10. A method of steering a drill string, the drill string including a remote steerable system (RSS), the RSS including a pad actuator and a steering collar, the pad actuator having a steering pad and a pad housing, the pad housing mounted on the steering collar, the steering pad pivotably coupled to the pad housing via a first hinge pin, the method comprising:

receiving, at the RSS, pressure from upstream with respect to the RSS;

directing the pressure to an actuation cylinder mounted on the steering collar;

extending a piston along a longitudinal axis of the actuation cylinder in response to the pressure, the piston directly connected to the steering pad by, and pivoting around, a second hinge pin while pushing the steering pad to extend laterally as the steering pad pivots around the first hinge pin, the piston maintaining an approximately similar gap with the cylinder while pivoting around the second hinge pin; and applying, by the steering pad, a steering force to a wall of a wellbore.

11. The method of claim 10, wherein receiving pressure includes receiving a pressurized fluid.

12. The method of claim 10, wherein receiving pressure includes receiving, at one of the pistons, a pressurized drilling mud and ejecting the pressurized mud from an orifice of the piston.

13. A drill string for forming a wellbore, the drill string comprising:

a drill bit; and a rotary steerable system (RSS) positioned upstream from the drill bit on the drill string, the RSS including:

a steering collar, the steering collar including a plurality of pockets;

a plurality of actuation cylinders, each actuation cylinder mounted within one of the pockets of the steering collar;

a plurality of barrel-shaped pistons, each barrel-shaped piston positionable within one of the actuation cylinders, each piston including a piston hanger; and two or more pad actuators, each pad actuator including:

a pad housing mounted on the steering collar; and a steering pad, wherein each steering pad is pivotably coupled to one of the pad housings via a first hinge pin and wherein each steering pad is directly connected via a second hinge pin to the piston hanger of at least one of the pistons, wherein each barrel-shaped piston is movable within its respective actuation cylinder such that, when extended out of the actuation cylinder, its respective steering pad pivots laterally from the steering collar on the first hinge pin to contact a side of the wellbore, urging the steering collar in a direction opposite the lateral direction.

14. The drill string of claim 13, wherein each piston moves within its respective actuation cylinder in response to an increase in hydraulic pressure, the movement causing the respective piston to pivot and laterally extend the steering pad to which the piston is coupled.

15. The drill string of claim 13, wherein each piston has a gap defined between the piston and its actuation cylinder.

16. The drill string of claim 13, wherein each piston has a gap defined between the piston and its respective actuation cylinder, each piston maintaining an approximately similar gap with the actuation cylinder as the piston pivots on the second hinge pin.

17. The drill string of claim 13, wherein each piston has a gap defined between the piston and its respective actuation cylinder, each piston maintaining an approximately similar gap with the actuation cylinder while traversing the actuation cylinder.

18. The drill string of claim 13, wherein the RSS further includes a radial seal positioned between each actuation cylinder and the steering collar.

19. The drill string of claim 13, wherein the steering collar includes a plurality of hydraulic chambers, each hydraulic chamber positioned adjacent to one of the pistons at one end of the piston's respective actuation cylinder, wherein pressurized fluid received by the RSS is directed to one or more of the hydraulic chambers and applied to the piston adjacent to the respective hydraulic chamber.

20. The drill string of claim 13, wherein the barrel-shaped piston rotates around the piston hanger.

* * * * *